United States Patent [19]

Helmink

[11] Patent Number: 4,680,160

[45] Date of Patent: Jul. 14, 1987

[54] METHOD OF FORMING A ROTOR

[75] Inventor: Randolph C. Helmink, Indianapolis, Ind.

[73] Assignee: TRW Inc., Cleveland, Ohio

[21] Appl. No.: 807,943

[22] Filed: Dec. 11, 1985

[51] Int. Cl.[4] ..... B22F 7/00

[52] U.S. Cl. ..... 419/6; 419/8; 419/42; 419/49; 29/23.5; 29/156.8 R

[58] Field of Search ..... 419/42, 49, 6, 8; 29/156.8 R, 23.5

[56] References Cited

U.S. PATENT DOCUMENTS

| | | | |
|---|---|---|---|
| 3,305,923 | 2/1967 | Zimmer | 29/528 |
| 3,780,418 | 12/1973 | Hurst | 419/6 |
| 3,905,723 | 9/1975 | Torti, Jr. | 416/241 |
| 3,939,241 | 2/1976 | Powell | 419/49 |
| 3,940,268 | 2/1976 | Catlin | 75/208 R |
| 4,051,585 | 10/1977 | Walker et al. | 29/156.8 |
| 4,063,939 | 12/1977 | Weaver | 419/49 |
| 4,096,615 | 6/1978 | Cross | 419/49 |
| 4,097,276 | 6/1978 | Six | 419/49 |
| 4,101,712 | 7/1978 | Bomford et al. | 428/547 |
| 4,329,175 | 5/1982 | Turner | 75/208 R |
| 4,479,293 | 10/1984 | Miller et al. | 29/156.8 |
| 4,529,452 | 7/1985 | Walker | 148/11.5 Q |
| 4,602,952 | 7/1986 | Greene et al. | 419/6 |

OTHER PUBLICATIONS

NASA Report No. CR-165224 entitled: "Development of Materials and Process Technology for Dual Alloy Disks", dated Oct. 1981, by C. S. Kortovich and J. M. Marder.

*Primary Examiner*—Stephen J. Lechert, Jr.

*Attorney, Agent, or Firm*—Tarolli, Sundheim & Covell

[57] ABSTRACT

An improved method of forming a rotor includes the steps of hot isostatically pressing powdered metal to form disc-shaped hub sections. Each of the hub sections has a rim portion with a relatively large or coarse grain size to optimize high temperature creep properties. The central portion of each hub section has a relatively small or fine grain size to optimize tensile strength and reduce cycle fatigue at intermediate temperatures. Dispersion of any defects in the hub sections is promoted by plastically deforming the hub sections. Preformed blades are placed in an annular array between a pair of the hub sections and the hub sections are bonded together to interconnect the blades and hub sections.

16 Claims, 12 Drawing Figures

METHOD OF FORMING A ROTOR

BACKGROUND OF THE INVENTION

The present invention relates to a new and improved method for forming a rotor and more specifically to a method of forming a rotor having a circular hub with a plurality of blades projecting from the hub.

The concept of forming the blades and hub of a rotor for a gas turbine engine of different materials is disclosed in U.S. Pat. No. 4,051,585. In practicing the method disclosed in this patent, a plurality of turbine blades are placed in a circular array. Preformed discs, having grooves in their radially outer edge portions, are pressed against the roots of the blades. The discs are diffusion bonded together. The discs are formed of a wrought superalloy having a fine grain microstructure.

U.S. Pat. No. 3,905,723 discloses the concept of making a gas turbine rotor by providing an annular array of preformed blades. Two preformed discs of carbide or silicon nitride molding powder are pressed together to form a hub which is connected with the blades.

The concept of arranging blades in a circular array and hot isostatically pressing powdered ceramic or superalloy materials around the blades is disclosed in U.S. Pat. Nos. 4,097,276 and 3,940,268. These patents contemplate that the hot isostatic pressing process will occur with the blades extending into the powder being bonded.

The hubs of the rotors formed in accordance with the foregoing patents will have substantially the same metallurgical characteristics throughout the radial extent of the hubs. However, the concept of forming a rotor from powdered metal and varying the metallurgical characteristics of the rotor by using powdered metal having different characteristics is disclosed in U.S. Pat. No. 4,329,175.

The concept of forming the rim portion of a disc with a coarse grain and forming the central portion of the disc with a fine grain is disclosed in NASA Report No. CR-165224 by Kortovich and Marder and entitled "Development of Materials and Process Technology for Dual Alloy Disks". The report indicates that the rim portion of a disc is formed from powdered metal by hot isostatic pressing of the powdered metal. The rim portion of the disc is then filled with powdered metal and is enclosed in a container. The enclosed rim portion and powdered metal are then subjected to a hot isostatic pressing operation.

SUMMARY OF THE PRESENT INVENTION

The present invention relates to a method of forming the hub of a rotor. In practicing the method, a plurality of hub sections are formed by hot isostatically pressing powdered metal. The hub sections are thermomechanically worked to promote the dispersion of any existing defects. The thermomechanical working effects plastic deformation of the hub sections at a temperature which is below the gamma-prime solvus temperature of the powdered metal which was hot isostatically pressed in forming the hub sections. After the hub sections have been thermomechanically worked, the end portions of a plurality of blades are placed between a pair of hub sections and the hub sections are bonded together.

In order to maximize the operating characteristics of a rotor, the rim portion of a hub section is formed of particles of metal which are bonded together in relatively large or coarse grains to optimize high temperature creep properties of the rim portion of the hub section. The central portion of the hub section, which is exposed to somewhat lower operating temperatures, is formed by bonding particles of metal together in relatively small or fine grains. This optimizes the tensile strength and low cycle fatigue characteristics of the central portion of the hub section.

Although the hub sections could be formed one at a time if desired, a plurality of the hub sections are advantageously formed at one time by hot isostatically pressing powdered metal to form a tubular member having an axial extent which is greater than the axial extent of a singular hub section. The tubular member itself is then filled with powdered metal and the opposite ends of the tubular member are closed. The tubular member, with the powdered metal therein, is then subjected to a hot isostatic pressing process to bond particles of powdered metal in the tubular member together and to bond these particles to the tubular member. The resulting solid workpiece is then plastically deformed by applying force against the outside of the workpiece to promote dispersion of any defects in the workpiece. After this has been done, the workpiece is divided into a plurality of separate hub sections.

Accordingly, it is an object of this invention to provide a new and improved method of forming a rotor by hot isostatically pressing powdered metal to form hub sections, plastically deforming the hub sections and bonding the hub sections together with a plurality of blades projecting from the hub sections.

Another object of this invention is to provide a new and improved method of forming a rotor wherein hub sections having a coarse grained rim portion and a fine grained central portion are bonded together with end portions of blades between the hub sections.

Another object of this invention is to provide a new and improved method of forming a rotor and wherein the method includes bonding particles of powdered metal together to form a tubular member, filling the tubular member with powdered metal, bonding together the particles of powdered metal in the tubular member to form a solid workpiece, and, thereafter, plastically deforming the workpiece to promote the dispersion of any defects in the workpiece.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Rotor Construction

Figure 1:
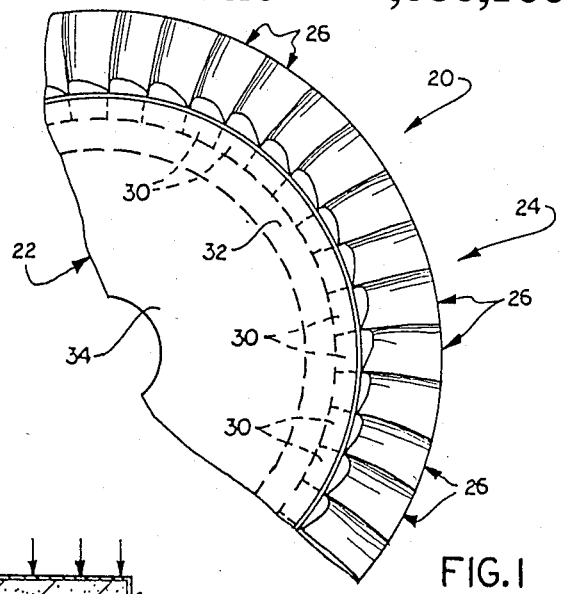
FIG. 1 is a fragmentary schematicized illustration of a rotor constructed by the method of the present invention.

A rotor 20 (FIG. 1) for a turbine engine has a circular hub 22 formed by the method of the present invention. An annular array 24 of blades 26 projects radially outwardly from the hub 22. The blades 26 have radially inner end portions or roots 30 which are encased by a rim portion 32 of the hub 22.

In accordance with a feature of the present invention, the rim portion 32 and a central portion 34 of the hub 22 are formed with different metallurgical characteristics to enhance the operating characteristics of the rotor 20. The rim and central portions 32 and 34 are formed of consolidated powdered metal, that is powdered metal in which the particles of powder have been compacted and bonded together. The annular rim portion 32 of the hub 22 has a relatively large or coarse grain to optimize the high temperature creep properties of the rim portion. The circular central portion 34 of the hub 22 has a relatively small or fine grain to optimize tensile strength and low cycle fatigue during use of the rotor 20 in a turbine engine.

When the rotor 20 is being used in a turbine engine, the rim portion 32 of the hub 22 is subjected to an operating temperature which may be approximately 400° F. above the operating temperature to which the central portion 34 of the hub is exposed. Therefore, it is important that the rim portion 32 have a substantial resistance to high temperature creep. During operation of the turbine engine, the loads and forces to which the central portion 34 of the hub 22 is subjected requires optimization of the tensile strength and low cycle fatigue characteristics of the central portion of the hub.

Method of Forming Rotor—Hub Sections

The hub 22 is formed of a pair of identical hub sections 38 and 40 (see FIG. 11) which are metallurgically bonded together. The annular rim portions 32 of the hub sections 38 and 40 are metallurgically bonded to the blade end or root portions 30 which are disposed between the hub sections 38 and 40.

Figure 2:
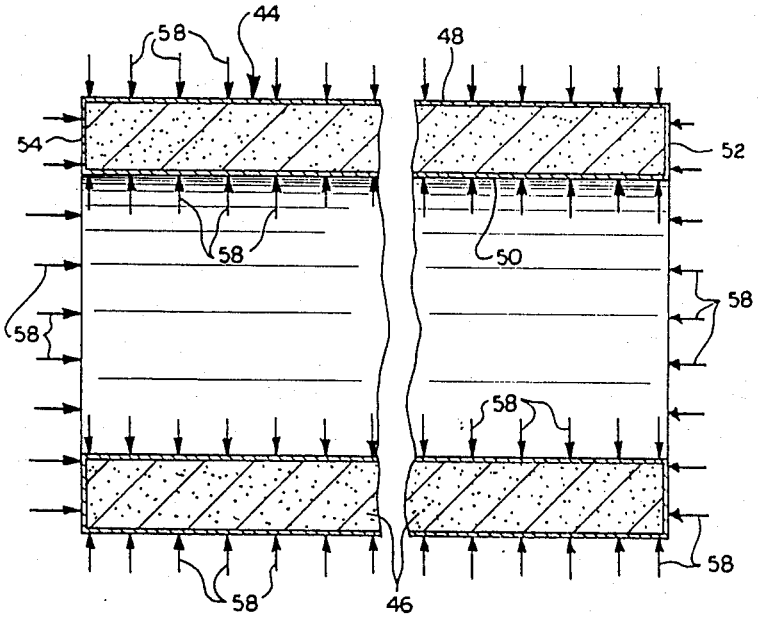
FIG. 2 is a sectional view schematically illustrating the manner in which powdered metal is enclosed in a container and subjected to a hot isostatic pressing operation to form a coarse grained tubular member.

Although the circular hub sections 38 and 40 could be formed one at a time, it is preferred to simultaneously form a plurality of the hub sections. In forming a plurality of the hub sections, a thin walled metal container 44 (see FIG. 2) is filled with metal powder 46. The tubular container 44 has a cylindrical outer side wall 48 which is connected with a cylindrical inner side wall 50 by a pair of annular end walls 52 and 54.

In one specific instance, the container 44 was formed of a mild steel. Ih this speciCfic instance, the side walls of the container had a thickness of approximately 0.25 of an inch. The joints between walls of the container were made fluid tight. However, it is contemplated that the container 44 could be formed with wall thicknesses different than the specific wall thickness set forth above. The container 44 could be formed by other methods, such as by an electro deposition process similar to the one disclosed in U.S. Pat. No. 4,065,303.

Once the container 44 has been filled with powdered metal, the container 44 is evacuated and sealed. The sealed container 44 is fluid tight. The sealed tubular container 44 is then subjected to a hot isostatic pressing operation.

During the hot isostatic pressing operation, the container 44 and powdered metal 46 are heated to a temperature which is slightly greater than the gamma-prime solvus temperature of the powdered metal. Fluid pressure is applied against the walls of the container in the manner indicated schematically by the arrows 58. The fluid pressure forces the thin metal side walls 48, 50, 52 and 54 of the container inwardly to compact the powdered metal 46.

Figure 3:
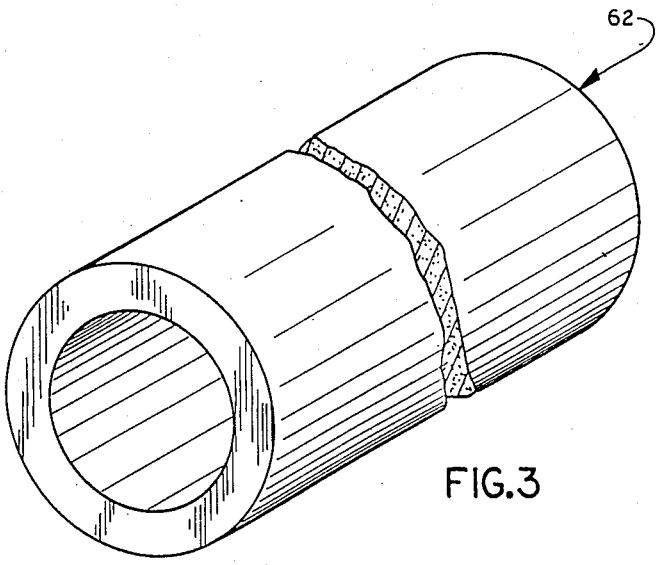
FIG. 3 is a fragmentary illustration of the tubular member formed by the hot isostatic pressing of powdered metal in the container of FIG. 2.

During the heating and compaction of the powdered metal 46, the particles of the powdered metal are bonded together to form relatively large or coarse grains. Upon cooling of the consolidated powdered metal, a rigid tubular member 62 (see FIG. 3) having a coarse grained construction results. Although the tubular member 62 is coarse grained, the tubular member is not gas permeable.

Although it is contemplated that the hot isostatic pressing operation could be done in many different ways using many different known types of powdered metal, in one specific instance, the powdered metal 46 was AF2-1DA-6, an experimental nickel-chrome alloy sold by Cy-Temp Specialty Steel Corp., of Pittsburgh, Pa., U.S.A. This specific powdered metal has a gamma-prime solvus temperature of approximately 2175° F. During the hot isostatic pressing of this specific powdered metal, the powdered metal 46 and container 44 were heated to and maintained at a temperature of between 2200° F. and 2300° F. While the container 44 was heated to this temperature, it was subjected to a pressure of 15,000 lbs. per square inch for approximately four hours. This resulted in a metallurgical bonding of the particles of powdered metal 46 to form grains having a size of 5 to 7 ASTM.

It should be understood that the foregoing powdered metal composition and the temperature, pressure and time for which the hot isostatic pressing operation was performed to obtain a particular grain size have been set forth herein for purposes of clarity of illustration and not for purposes of limitation of the invention. The entire hot isostatic pressing operation takes place in an autoclave having a known construction, such as the construction described in the article entitled "Gas-Pressure Bonding Techniques" set forth in the text *Techniques of Metal Research,* Vol. 1, part 3, published by Wiley Interscience, 1968.

After the hot isostatic pressing operation, the container 44 is removed from around the resulting rigid tubular member 62. The container 44 may be removed by selective acid dissolution of the material of the container from the tubular member 62. Of course, other methods of removing the container, such as machining or mechanical stripping may be used.

The solid tubular member 62 forms the rim portion 32 of a plurality of hub sections 38 and 40. In order to form the central portion 34 of the hub sections, the tubular member 62 is filled with powdered metal 66 (see FIG. 4). The axially opposite ends of the tubular member 62 are closed by thin metal panels 68 and 70. The circular metal panels 68 and 70 bulge axially outwardly so that the cylindrical body of powdered metal 66 within the tubular member 62 has an axial extent which is slightly greater than the axial extent of the tubular member 62.

Once the tubular member 62 has been filled with powdered metal, the inside of the tubular member 62 is evacuated and the panels 68 and 70 are sealed against the axially opposite ends of the tubular member 62. The rigid tubular member 62 is not porous and fluid cannot flow through the cylindrical wall of the tubular member 62 into the cylindrical body of powdered metal 66.

The body of powdered metal 66 within the sealed tubular member 62 (FIG. 4) is then subjected to a hot isostatic pressing operation to consolidate the particles of the powdered metal 66. Thus, the tubular member 62 and powdered metal 66 is heated and the tubular member and end panels 68 and 70 are exposed to fluid pressure which has been indicated schematically by the arrows 72 in FIG. 4. The fluid pressure against the end panels 68 and 70 forces them axially inwardly and the powdered metal 66 is compacted to have an axial extent which is substantially the same as the axial extent of the tubular member 62.

The heat and pressure results in a bonding of the particles of the powdered metal 66 together to form a solid cylindrical core 78 (FIG. 5) within the tubular member 62 and to metallurgically bond the solid core to the tubular member 62. The temperature at which the hot isostatic pressing operation is conducted to consolidate the powdered metal 66 is somewhat lower than the temperature at which the hot isostatic pressing operation was conducted to form the tubular member 62. Therefore, the core 78 enclosed by the tubular member 62 has a relatively small or fine grain size.

In one specific instance, the powdered metal 66 was the aforementioned AF2-1DA-6. The tubular member 62 and powdered metal 66 were, during one specific hot isostatic pressing operation, heated to a temperature of 2000° to 2100° F. While the powdered metal was at this temperature, a pressure 72 (FIG. 4) of 15,000 psi was maintained for a period of approximately four hours. This resulted in the particles of the powdered metal 66 being bonded together with a grain size of approximately 8 to 9 ASTM. In addition to the bonding together of the particles of powdered metal, a secure metallurgical bond was obtained between the particles of the metal powder 66 and the tubular member 62.

As a result of metallurgically bonding the particles of powdered metal 66 together and of bonding the particles to the tubular member 62, a unitary workpiece 76 (FIG. 5) is formed. The end panels 68 and 70 are removed from the workpiece 76 by acid dissolution, machining or mechanical stripping. The resulting workpiece 76 has a solid cylindrical configuration with a fine grained cylindrical core 78, formed by the powdered metal 66, and a relatively coarse grained outer layer 79, formed by the tubular member 62.

Figure 6:
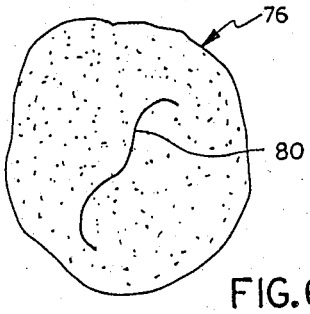
FIG. 6 is an enlarged and highly schematicized illustration of a defect in the workpiece of FIG. 5 prior to plastic deformation of the workpiece.

During the hot isostatic pressing process to form the workpiece 76, it is contemplated that defects may be formed in the workpiece. These defects can be the result of the accumulation of foreign materials, incomplete bonding at locations within the workpiece 76, and on powder boundary surfaces. A defect 80 in the workpiece 76 has been illustrated schematically in FIG. 6.

If the defect 80 was allowed to remain in the hub portion 22 of the turbine rotor 20, a catastrophic failure could occur. In order to promote dispersion and/or elimination of the defect 80, the workpiece 76 is subjected to thermomechanical working. During the thermomechanical working, the workpiece 76 is heated to a temperature below its recrystallization temperature, that is, at a temperature below the gamma-prime solvus temperature, and plastically deformed.

Figure 5:
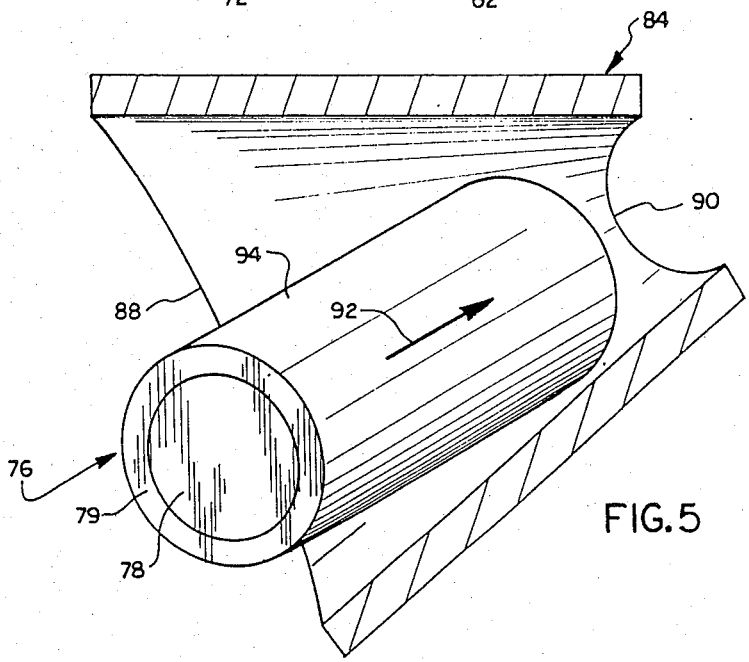
FIG. 5 is a schematic illustration of the manner in which the solid workpiece is plastically deformed by a thermomechanical working process to promote the dispersion of any defects in the workpiece.

Although this thermomechanical working could be accomplished in many different ways, it is preferred to plastically deform the workpiece 76 by extruding it through a heated die 84 which has been illustrated schematically in FIG. 5. The die 84 has a relatively large opening 88 at one end and a relatively small opening 90 at the opposite end. The circular opening 88 has a diameter which is substantially greater than the outside diameter of the workpiece 76. However, the die 84 tapers axially to a relatively small circular opening 90 having a diameter which is less than the outside diameter of the workpiece 76. A die that may be used to advantage is disclosed in U.S. patent application Ser. No. 698,728 filed Feb. 6, 1985 by H. A. Gegal.

When the heated workpiece 76 is moved axially through the die heated 84, in the manner indicated by the arrow 92 in FIG. 5, the force applied against the cylindrical outer side surface 94 of the workpiece 76 squeezes the workpiece. This squeezing action plastically deforms the workpiece 76 to reduce its outside diameter. Although the temperature to which the workpiece 76 and die 84 are heated may vary, the die and workpiece were, in one specific instance, heated to temperatures in the range of 1300° F. to 2100° F. for the workpiece 76 and 500° F. to 800° F. for the die 84.

Figure 7:
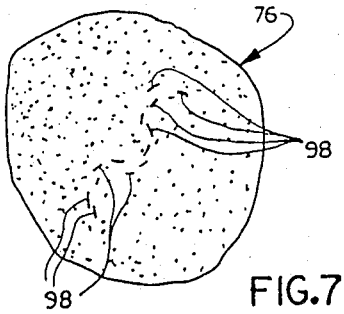
FIG. 7 is a highly schematicized illustration of the defect of FIG. 6 after the workpiece has been plastically deformed.

During extrusion of the workpiece 76, the material of the workpiece shifts radially and axially. By shifting the material of the workpiece 76, the defect 80 is dispersed in the manner which has been illustrated schematically in FIG. 7. Thus, the defect 80 was broken up into a plurality of relatively small segments or particles 98. The relatively small particles 98 are not of a size sufficient to cause a failure of the hub portion 22 of the turbine wheel 20.

Figure 8:
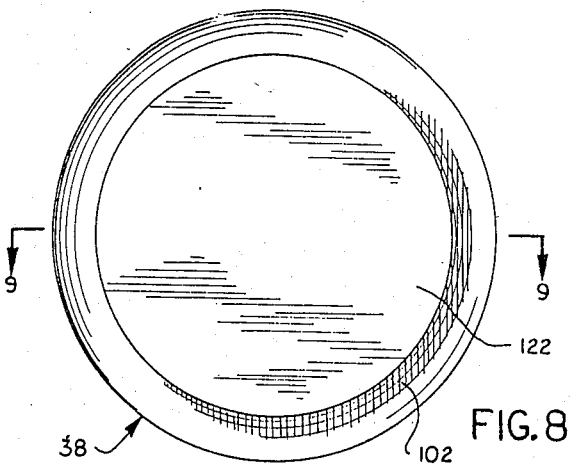
FIG. 8 is a plan view of a hub section severed from the workpiece of FIG. 5 after the plastic deformation of the workpiece.

After the thermomechanical working process, that is the hot extrusion of the workpiece 76 through the die 84, the workpiece is divided into a plurality of identical disc-shaped hub sections 38 and 40 (see FIG. 8). This is accomplished by severing the workpiece 76 along planes extending perpendicular to the central axis of the cylindrical workpiece. Of course, the distance between the locations at which the workpiece 76 is severed will determine the axial extent of the hub sections 38 and 40. It is contemplated that the workpiece 76 will have an axial length sufficient to enable ten or more hub sections 38 and 40 to be formed from a single workpiece.

Figure 9:
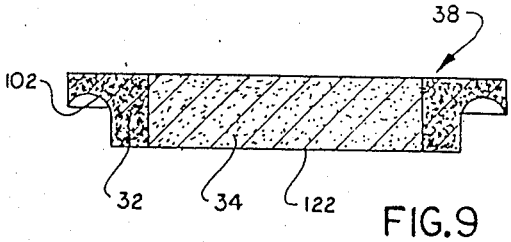
FIG. 9 is a sectional view, taken along the line 9—9 of FIG. 8, schematically illustrating a coarse grained rim portion and fine grained central portion of the hub section.

When the circular hub sections 38 and 40 are separated from the workpiece 76, the hub sections have flat parallel sides. The annular rim portion 32 (FIG. 9) of hub section 38 has a coarse grain corresponding to the coarse grain of the tubular member 62. The circular central portion 34 of the hub section has a fine grain corresponding to the fine grain of the core 78.

After the hub sections 38 and 40 have been severed from the workpiece 76, an annular groove or recess 102 is machined in the rim portion 32 of each of the hub sections formed from the workpiece 76. Although only the annular recess 102 in the hub section 38 has been illustrated in FIGS. 8 and 9 of the drawings, it should be understood that a similar recess is cut in each of the hub sections formed from the workpiece 76.

Method of Forming Rotor-Blades

Figure 10:
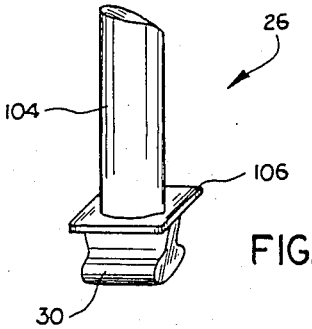
FIG. 10 is a schematic illustration of a blade.
Figure 11:
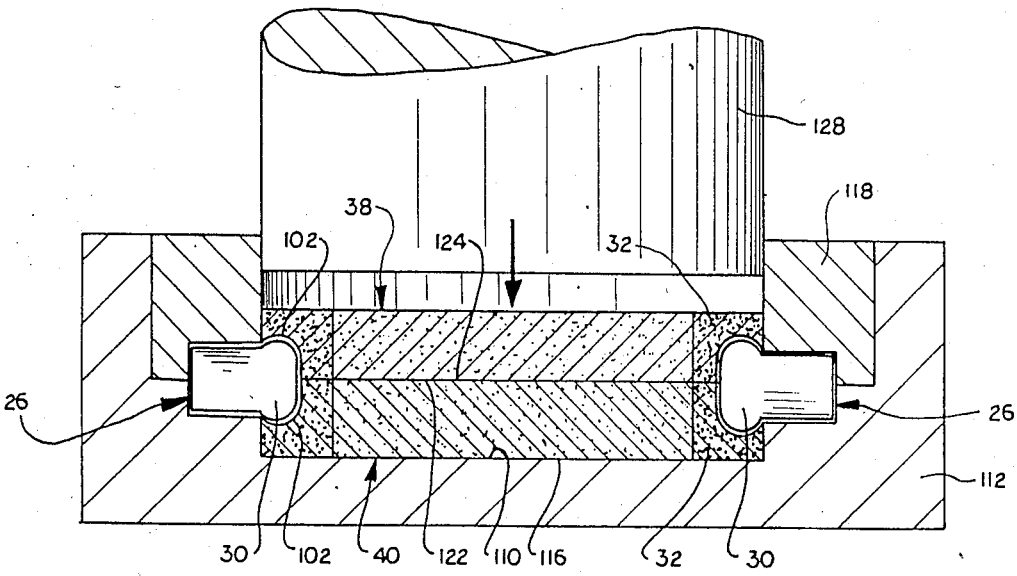
FIG. 11 is a schematic illustration depicting the manner in which end portions of a plurality of blades are placed between a pair of hub sections which are then bonded together to form the rotor of FIG. 1.

Each of the blades 26 (FIG. 10) has a root portion 30 which is received in the grooves 102 formed in a pair of hub sections 38 and 40 (FIG. 11). The root portion 30 of the blade is formed as a segment of a circle. In addition to the root portion 30, the blade 26 has an airfoil portion 104 (FIG. 10) and a platform 106. The blade 26 could have many different constructions. However, in order to optimize the operating characteristics of the blade 26, it is contemplated that it will have either a columnar grained crystallographic structure, similar to that shown in U.S. Pat. No. 3,260,505 or a single crystal crystallographic structure similar to that shown in U.S. Pat. No. 3,536,121. Of course, blades having a different crystallographic structure could be used if desired.

A plurality of the blades 26 are arranged in a circumferential array extending radially outward from the hub surface with the airfoil portions 104 projecting outwardly from the hub sections 38 and 40 (FIG. 11). Therefore, there is a continuous series of root end portions 30 disposed in engagement with the grooves 102 in the hub sections 38 and 40.

Method of Forming Rotor-Interconnecting Blades and Hub Sections

A pair of hub sections 38 and 40 and an annular array of blades 26 are metallurgically bonded together by a hot isothermal forging process. Thus, the hub section 40 is placed in a circular cavity 110 (FIG. 11) in a forging die 112. A flat radially extending bottom surface of the circular hub section 40 is disposed in abutting engagement with the bottom surface of the die cavity 110.

The root portions 30 of a plurality of blades 26 are then positioned in the annular groove 102 formed in the rim portion 32 of the hub section 40 (FIG. 11). An array of the ring segments 118 is then placed in engagement with the blades 26 which, in cooperation with the lower die 112, hold them against movement relative to the hub section 40. The annular recess 102 in the rim portion 32 of the hub section 38 is then positioned over the upper sides of the blade root portions 30. A flat radially extending side surface 122 on the upper hub section 38 is disposed in abutting engagement with a corresponding flat radially extending side surface 124 of the lower hub section 40.

After the hub sections 38 and 40 and blades 26 have been heated, a heated ram 128 is lowered to press the hub sections 38 and 40 together and to press the hub sections against the root portions 30 of the blades 26. The pressure applied against the heated hub sections 38 and 40 by the ram 128 results in the formation of a secure metallurgical bond between the hub sections 38 and 40 and between the hub sections and the blades 26 to form a unitary turbine rotor 20.

In one specific instance, the isothermal forging of the hub sections 38 and 40 to metallurgically bond them together and to metallurgically bond them with the blades 26 was performed at a temperature of approximately 2100° F. and under a pressure of approximately 6,000 to 8,000 psi. Of course, other temperatures and pressures could be used if desired.

When the hub sections 38 and 40 are forged together, the material of the rim portions 32 of the hub sections 38 and 40 is moved along the outer side surfaces of the root portions 30 of the blades 26. This disperses any impurities which may be overlaying the root portions 30 of the blades 26.

Figure 12:
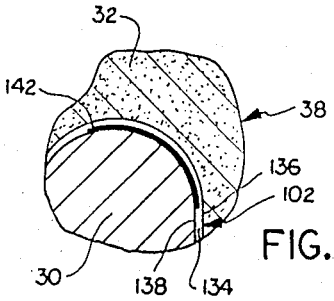
FIG. 12 is an enlarged fragmentary view schematically illustrating the relationship between a hub section and an end portion of a blade in FIG. 11.

When the blades 26 are placed in the grooves 102, there is a small annular gap 134 (FIG. 12), between an inner side surface 136 of the groove 102 and the outer side surface 138 of the blade. As the ram 128 is lowered, the gap 134 is eliminated and the material of the rim portions 32 of the hub sections 38 and 40 moves along the outer side surfaces 138 of the root end portions of the blades 26. This results in a wiping action which tends to break up or disperse any impurities or foreign materials 142 (FIG. 12) on the outer side surfaces 138 of the blades.

The wiping action occurs as the rim portion 32 of the hub section 38 is forced downwardly (as viewed in FIG. 12) by the ram 128. As the rim portion 32 moves relative to the blade, the inner side surface 136 of the groove 102 moves downwardly against the layer 142 of impurities. As this happens, the layer 142 of impurities is broken up and dispersed so as to minimize the effect of the impurities. Of course, every effort is made to avoid the presence of impurities corresponding to the impurities 142.

SUMMARY

The present invention relates to a method of forming the hub 22 of a rotor 20. In practicing the method, a plurality of hub sections 38 and 40 are formed by hot isostatically pressing powdered metal. The hub sections 38 and 40 are thermomechanically worked to promote the dispersion of defects. The thermomechanical working (FIG. 5) effects plastic deformation of the hub sections 38 and 40 at a temperature which is below the gamma-prime solvus temperature of the powdered metal which was hot isostatically pressed in forming the hub sections 38 and 40. After the hub sections 38 and 40 have been thermomechanically worked, the end portions 30 of a plurality of blades 26 are placed between the hub sections 38 and 40 (FIG. 11) and the hub sections are metallurgically bonded together.

In order to maximize the operating characteristics of the rotor 20, the rim portions 32 of the hub sections 38 and 40 are formed of particles of metal which are bonded together in relatively large or coarse grains to optimize high temperature creep properties of the rim portion of the hub section. The central portions 34 of the hub sections 38 and 40 are exposed to somewhat lower operating temperatures. Therefore, the central portions 34 of hub sections 38 and 40 are formed by bonding particles of metal together in relatively small or fine grains in order to optimize the tensile strength and low cycle fatigue characteristics.

Figure 4:
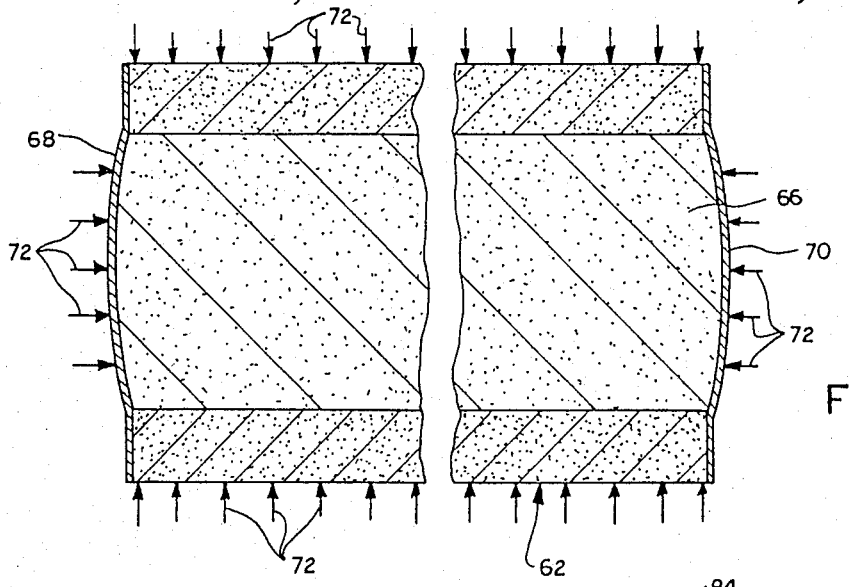
FIG. 4 is a sectional view illustrating how the tubular member of FIG. 3 is filled with powdered metal, the ends of the member closed, and the powdered metal in the member subjected to a hot isostatic pressing operation to form a solid workpiece.

Although the hub sections 38 and 40 could be formed one at a time if desired, a plurality of the hub sections are advantageously formed at one time by hot isostatically pressing powdered metal to form a tubular member 62 having an axial extent which is greater than the axial extent of a singular hub section. The tubular member 62 itself is then filled with powdered metal 66 and the opposite ends of the tubular member are closed (FIG. 4). The tubular member 62, with the powdered metal 66 therein, is then subjected to a hot isostatic pressing process to bond particles of powdered metal in the tubular member to form a compacted core material and concurrently bond the compacted core to the inside of the tubular member. The resulting solid workpiece 76 is then plastically deformed by applying force against the outside of the workpiece to promote dispersion of any defects in the workpiece. The fully formed workpiece 76, which is in the form of a solid cylinder, is divided into a plurality of separate hub sections by cutting it diametrically into sections, including the hub sections 38 and 40.

Having described specific preferred embodiments of the invention, the following is claimed:

1. A method of forming a rotor having a circular hub with a plurality of blades projecting from the hub, said method comprising the steps of forming a plurality of hub sections, said step of forming a plurality of hub sections including hot isostatically pressing powdered metal to at least partially form the hub sections, plastically deforming the hub sections by applying force against the hub sections while the hub sections are at a temperature below the gama-prime solvus temperature of the powdered metal which was hot isostatically pressed in forming the hub sections, thereafter, placing end portions of a plurality of blades between a pair of hub sections, and bonding the pair of hub sections together with the blades projecting from the hub sections.

2. A method of forming a rotor as set forth in claim 1 wherein said step of hot isostatically pressing powdered metal to form the hub sections includes the steps of hot isostatically pressing a first body of powdered metal to form a rim portion of a hub section, hot isostatically pressing a second body of powdered metal to form a central portion of a hub section, and bonding the first and second bodies of powdered metal together.

3. A method of forming a rotor as set forth in claim 2 wherein said step of hot isostatically pressing a first body of powdered metal to form a rim portion of a hub section includes hot isostatically pressing the first body of powdered metal at a temperature high enough to form large grains, said step of hot isostatically pressing a second body of powdered metal to form a central portion of a hub section includes hot isostatically pressing the second body of powdered metal at a relatively low temperature to form small grains.

4. A method of forming a rotor as set forth in claim 3 wherein said step of bonding the first and second bodies of powdered metal together is performed simultaneously with said step of hot isostatically pressing the second body of powdered metal.

5. A method of forming a rotor as set forth in claim 4 wherein said step of hot isostatically pressing a first body of powdered metal forms a rigid rim portion of a hub section, said step of hot isostatically pressing a second body of powdered metal to form a central portion of the hub section includes circumscribing the second body of powdered metal with the rigid rim portion and subjecting the second body of powdered metal to heat and pressure while the second body of powdered metal is circumscribed by the rigid rim portion.

6. A method of forming a rotor as set forth in claim 1 wherein said step of hot isostatically pressing powdered metal forms a cylindrical workpiece, said step of plastically deforming the hub sections includes the step of decreasing the outside diameter of the cylindrical workpiece by applying force against an outer side surface of the workpiece.

7. A method of forming a rotor as set forth in claim 6 wherein the cylindrical workpiece has an axial extent which is greater than the axial extent of a hub section, said step of forming a plurality of hub sections further including the step of dividing the workpiece to form a plurality of disc sections after performing said step of decreasing the outside diameter of the cylindrical workpiece.

8. A method of forming a rotor as set forth in claim 7 wherein said step of forming a plurality of hub sections further includes the step of forming a recess in a rim portion of a first one of the disc sections, said step of placing end portions of a plurality of blades between a pair of hub sections includes placing the end portions of a plurality of blades in the recess in the rim portion of the first disc section.

9. A method of forming a rotor as set forth in claim 8 wherein said step of placing end portions of a plurality of blades between a pair of hub sections includes placing a second one of the disc sections in axial alignment with the first disc section, said step of bonding the pair of hub sections together includes the steps of applying axial forces against the first and second disc sections to press them against each other and to press them against the end portions of the plurality of blades.

10. A method of forming a rotor as set forth in claim 9 wherein said step of applying axial forces against the first and second disc sections includes pressing the material of the first disc section against the end portions of the plurality of blades and moving the material along the surfaces of the end portions of the plurality of blades with a wiping action to promote dispersion of any impurities on the surfaces of the end portions of the blades.

11. A method of forming a rotor as set forth in claim 1 wherein said step of forming a plurality of hub sections includes forming hub sections having a circular configuration and having metallurgical characteristics which vary along radial planes through the hub sections.

12. A method of forming a rotor as set forth in claim 1 wherein said step of bonding a pair of hub sections together includes establishing a metallurgical bond between flat side surfaces of the pair of hub sections.

13. A method of forming a rotor as set forth in claim 1 further including establishing a metallurgical bond between the end portions of the plurality of blades and the pair of hub sections.

14. A method of forming a rotor as set forth in claim 1 wherein said step of forming a plurality of hub sections includes enclosing a first body of powdered metal in a container having an annular cross sectional configuration, said step of hot isostatically pressing powdered metal includes exposing the container of powdered metal to fluid at a relatively high temperature and pressure to bond together particles of powder in the first body of powdered metal, said step of forming a plurality of hub sections further includes the step of removing the container from the bonded together the particles of powdered metal in the first body of powdered metal to leave a tubular member, filling the tubular member with a second body of powdered metal, and attaching a pair of panels to opposite axial ends of the tubular member to enclose the second body of powdered metal, said step of hot isostatically pressing powdered metal further including exposing the outer side surface of the tubular member and the panels to fluid at a relatively high temperature and pressure to bond together particles of powder in the second body of powdered metal.

15. A method of forming a rotor having a circular hub with a plurality of blades projecting from the hub, said method comprising the steps of forming a plurality of circular disc sections of compacted and bonded metal powder, said step of forming a plurality of circular disc sections including the steps of forming the disc sections with rim portions having particles of metal powder bonded together in relatively large grains and with central portions having particles of metal powder bonded together in relatively small grains, placing end portions of a plurality of blades between rim portions of a pair of the disc sections with flat side surfaces of the pair of disc sections adjacent to each other, metallurgically bonding the adjacent flat side surfaces of the pair of disc sections together, metallurgically bonding the rim portions of the pair of disc sections to the end portions of the blades, and maintaining relatively large grains in the rim portions and relatively small grains in the central portions of the pair of disc sections during said bonding steps.

16. A method as set forth in claim 15 wherein said step of metallurgically bonding the rim portions of the pair of disc sections to the end portions of the blades includes moving the material of the rim portions of the pair of disc sections along the end portions of the plurality of blades with a wiping action to promote dispersion of any impurities on the surfaces of the end portions of the blades.

* * * * *